US010875016B2

(12) United States Patent
Sato et al.

(10) Patent No.: US 10,875,016 B2
(45) Date of Patent: Dec. 29, 2020

(54) MICRO ANALYSIS CHIP AND FABRICATION METHOD THEREOF

(71) Applicants: PANASONIC CORPORATION, Osaka (JP); IMEC VZW, Leuven (BE)

(72) Inventors: Shuji Sato, Nara (JP); Yasuaki Okumura, Kyoto (JP); Yukari Nishiyama, Tokyo (JP); Tatsurou Kawamura, Kyoto (JP); Ben Jones, Leuven (BE); Liesbet Lagae, Leuven (BE); Tim Stakenborg, Leuven (BE)

(73) Assignees: PANASONIC CORPORATION, Osaka (JP); IMEC VZW, Leuven (BE)

( * ) Notice: Subject to any disclaimer, the term of this patent is extended or adjusted under 35 U.S.C. 154(b) by 305 days.

(21) Appl. No.: 15/899,982

(22) Filed: Feb. 20, 2018

(65) Prior Publication Data

US 2018/0169653 A1 Jun. 21, 2018

Related U.S. Application Data

(63) Continuation of application No. PCT/JP2016/003655, filed on Aug. 8, 2016.

(30) Foreign Application Priority Data

Aug. 20, 2015 (JP) ..... 2015-163050

(51) Int. Cl.
*B01L 3/00* (2006.01)

(52) U.S. Cl.
CPC ..... *B01L 3/502707* (2013.01); *B01L 3/50273* (2013.01); *B01L 3/502715* (2013.01);
(Continued)

(58) Field of Classification Search
CPC ..... B01L 3/502707; B01L 3/5027; B01L 3/502715; B01L 3/50273; B01L 2300/0861; B01L 2300/087; B01L 2300/0877
See application file for complete search history.

(56) References Cited

U.S. PATENT DOCUMENTS

2003/0148504 A1* 8/2003 Duong ..... B01L 3/502715 435/287.2
2005/0164402 A1 7/2005 Belisle et al.
(Continued)

FOREIGN PATENT DOCUMENTS

JP 2009-47485 3/2009

OTHER PUBLICATIONS

International Preliminary Report on Patentability dated Feb. 20, 2018 in International (PCT) Application No. PCT/JP2016/003655.
(Continued)

*Primary Examiner* — Livius R. Cazan
(74) *Attorney, Agent, or Firm* — Wenderoth, Lind & Ponack, L.L.P.

(57) ABSTRACT

A micro analysis chip comprises an inlet and a fluid flow path communicating thereto. The fluid flow path comprises a first flow path, a second flow path, and a third flow path arranged continuously along a longitudinal direction of the fluid flow path. An antibody is bound on at least one peripheral surface selected from the group consisting of peripheral surfaces of the second and third flow paths. A cross-sectional area of the third flow path is constant or increased monotonically along a direction X from the second flow path toward the third flow path. A cross-sectional area of the second flow path is increased monotonically along the direction X from the one end to the other end of the second flow path. A cross-sectional area of the first flow
(Continued)

path is larger than a cross-sectional area at the one end of the second flow path.

4 Claims, 10 Drawing Sheets

(52) U.S. Cl.
CPC ... *B01L 3/502746* (2013.01); *B01L 2300/041* (2013.01); *B01L 2300/087* (2013.01); *B01L 2300/0809* (2013.01); *B01L 2300/0816* (2013.01); *B01L 2300/0851* (2013.01); *B01L 2300/0861* (2013.01); *B01L 2300/0877* (2013.01); *B01L 2400/0406* (2013.01); *B01L 2400/0688* (2013.01)

(56) References Cited

U.S. PATENT DOCUMENTS

| | | | | |
|---|---|---|---|---|
| 2010/0075109 | A1 | 3/2010 | Takagi | |
| 2012/0288408 | A1 | 11/2012 | Ono et al. | |
| 2014/0332098 | A1 | 11/2014 | Juncker et al. | |
| 2015/0107709 | A1* | 4/2015 | Peng | B01L 3/50273 137/806 |
| 2015/0252414 | A1* | 9/2015 | Bai | C12Q 1/6869 216/2 |

OTHER PUBLICATIONS

International Search Report dated Nov. 21, 2016 in International (PCT) Application No. PCT/JP2016/003655.

* cited by examiner

MICRO ANALYSIS CHIP AND FABRICATION METHOD THEREOF

CROSS-REFERENCE TO RELATED APPLICATIONS

This is a continuation application of International Application No. PCT/JP2016/003655, with an international filing date of Aug. 8, 2016, which claims priority of Japanese Patent Application No. 2015-163050 filed on Aug. 20, 2015, the content of which is incorporated herein by reference.

BACKGROUND OF THE INVENTION

1. Technical Field

The technical field relates to a micro analysis chip and a fabrication method thereof.

2. Description of Related Art

FIG. 10 is a duplicate of FIG. 5 included in Japanese Patent Application laid open Unexamined Publication No. 2009-047485A, which discloses a microinspection chip and inspection device. In this document, a microinspection chip 800 is prepared first. The microinspection chip 800 has a mixed liquid flow channel 141, an amplifying part 811, and a drain flow channel 151. The amplifying part 811 has a wall 811*a* and a wall 811*b* close to the mixed liquid flow channel 141 and the drain flow channel 151, respectively. The wall 811 and the wall 811*b* face each other.

A mixture of a liquid 123 and a liquid 133 is supplied from the mixed liquid flow channel 141 to the amplifying part 811 in such a manner that an interface 161 of the mixture is not in contact with the wall 811*b*. Then, the mixture is heated with a heater 223 to obtain a product liquid 161. The product liquid 161 located on a detection region 255 included in the amplifying part 811 is analyzed using a detection part 250 including a light source 251 and a light-receiving element 253. Finally, the valve is open to drain the product liquid 161 through the drain flow channel 151.

SUMMARY

One non-limiting and exemplary embodiment provides a fabrication method thereof.

In one general aspect, the techniques disclosed here feature: a method for fabricating a micro analysis chip, the method including:

(a) providing a first substrate comprising a fluid flow path;

wherein the fluid flow path comprises a first flow path, a second flow path, and a third flow path which are arranged continuously along a longitudinal direction of the fluid flow path;

the second flow path has one end and another end;

the first flow path communicates with the second flow path through the one end of the second flow path;

the second flow path is interposed between the first flow path and the third flow path;

the second flow path communicates with the third flow path through the other end of the second flow path;

a cross-sectional area of the third flow path is constant or increased monotonically along a direction X from the first flow path toward the second flow path in the top view of the first substrate;

a cross-sectional area of the second flow path is increased monotonically along the direction X from the one end to the other end of the second flow path in the top view of the first substrate; and a cross-sectional area of the first flow path is larger than a cross-sectional area at the one end of the second flow path in the top view of the first substrate;

(b) dropping an aqueous solution containing an antibody onto a peripheral surface of the second flow path;

wherein the following relation (IAA) is satisfied:

$$LS \leq L2 + L3 \quad \text{(IAA)}$$

where

LS represents the length of the aqueous solution from the one end of the second flow path along the longitudinal direction of the fluid flow path;

L2 represents the length of the second flow path along the longitudinal direction in the fluid flow path; and L3 represents the length of the third flow path along the longitudinal direction in the fluid flow path; and (c) drying the aqueous solution to bind the antibody to the peripheral surface of the second flow path;

wherein one end of the aqueous solution is located at the one end of the second flow path;

the other end of the aqueous solution moves along a direction opposite to the direction X;

the antibody is immobilized on the peripheral surface of the second flow path; and the following relation (IBB) is satisfied:

$$LA < LS' < LS \quad \text{(IBB)}$$

where

LA represents a distance between the antibody immobilized on the peripheral surface of the second flow path and the one end of the second flow path; and LS' represents the length of the aqueous solution in the step (c).

Additional benefits and advantages of the disclosed embodiments will be apparent from the specification and figures. The benefits and/or advantages may be individually provided by the various embodiments and features of the specification and drawings disclosure, and need not all be provided in order to obtain one or more of the same.

BRIEF DESCRIPTION OF DRAWINGS

The present disclosure will become readily understood from the following description of non-limiting and exemplary embodiments thereof made with reference to the accompanying drawings, in which like parts are designated by like reference numeral and in which.

DETAILED DESCRIPTION

Hereinafter, the embodiment of the present invention will be described with reference to the drawings.

(Micro Analysis Chip)

First, a micro analysis chip according to the present embodiment will be described. The micro analysis chip is used for Micro-Total Analysis system (hereinafter, referred to as "μ-TAS") in which an ingredient included in a small amount of a liquid sample is analyzed. An example of the liquid sample is blood, urine, or sweat obtained from an animal including a human.

Figure 1A:
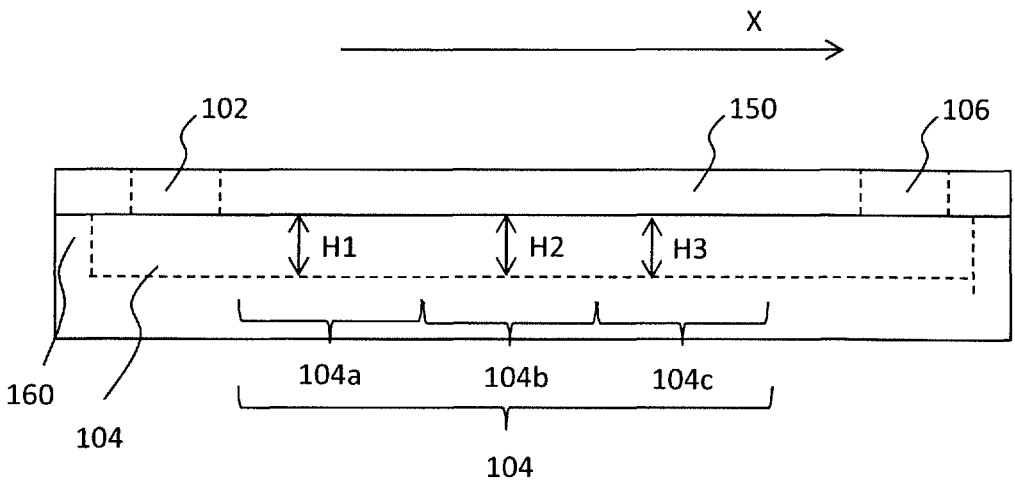
FIG. 1A shows a cross-sectional view of a micro analysis chip according to an embodiment.
Figure 1B:
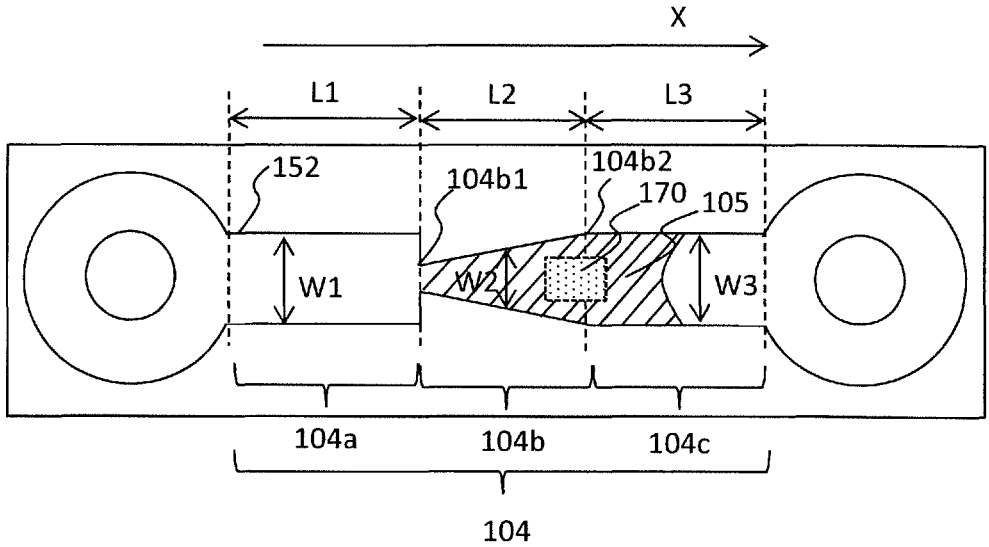
FIG. 1B shows a top view of the micro analysis chip.

FIG. 1A shows a cross-sectional view of the micro analysis chip 100 used in the embodiment. The micro analysis chip 100 comprises an upper substrate 150 and a lower substrate 160, as shown in FIG. 1A. The lower substrate 160 and the upper substrate 150 may be referred to as a first substrate and a second substrate, respectively. FIG. 1B shows a top view of the micro analysis chip 100. To be exact, FIG. 1B shows a top view of the lower substrate 160. In FIG. 1B, the upper substrate 150 is omitted.

The back surface of the upper substrate 150 adheres to the front surface of the lower substrate 160, as shown in FIG. 1A. The upper substrate 150 comprises an inlet 102 and an outlet 106. The inlet 102 and the outlet 106 penetrate the upper substrate 150. The lower substrate 160 comprises a fluid flow path 104 on the surface thereof. The fluid flow path 104 communicates with the inlet 102 and the outlet 106. Since the fluid flow path 104 is narrow, capillary force occurs in the fluid flow path 104.

As just described, the micro analysis chip 100 comprises the inlet 102, the fluid flow path 104, and the outlet 106. The liquid sample is supplied to the inlet 102. Then, the liquid sample held on the fluid flow path 104 is analyzed. Finally, the liquid sample is drained from the fluid flow path 104 through the outlet 106.

In FIG. 1A and FIG. 1B, the fluid flow path 104 is formed on the front surface of the lower substrate 160. Alternatively, the fluid flow path 104 may be formed on the back surface of the upper substrate 150. In addition, the fluid flow path 104 may be formed on both of the back surface of the upper substrate 150 and the front surface of the lower substrate 160. In this case, the fluid flow path formed on the back surface of the upper substrate 150 has the same shape as the fluid flow path formed on the front surface of the lower substrate 160.

As shown in FIG. 1B, the fluid flow path 104 comprises a first flow path 104*a*, a second flow path 104*b*, and a third flow path 104*c*. These paths are arranged continuously along the longitudinal direction of the fluid flow path 104.

The second flow path 104*b* has one end 104*b*1 and the other end 104*b*2 at the sides of the inlet 102 and the outlet 106, respectively.

The first flow path 104*a* is interposed between the inlet 102 and the second flow path 104*b*. The first flow path 104*a* communicates with second flow path 104*b* through the one end 104*b*1 of the second flow path 104*b*.

The second flow path 104*b* is interposed between the first flow path 104*a* and the third flow path 104*c*. The second flow path 104*b* communicates with the third flow path 104*c* through the other end 104*b*2 of the second flow path 104*b*.

As just described, since the first flow path 104*a* and the second flow path 104*b* are arranged continuously along the longitudinal direction of the fluid flow path 104, another flow path is absent between the first flow path 104*a* and the second flow path 104*b*. In other words, the first flow path 104*a* communicates with the second flow path 104*b* directly. Similarly, another flow path is absent between the second flow path 104*b* and the third flow path 104*c*. In other words, the second flow path 104*b* communicates with the third flow path 104*c* directly.

Capillary force may occur in all of the first-third flow paths 104*a*-104*c*. In the present invention, capillary force occurs in at least the second flow path 104*b*, since the second flow path 104*b* includes a part having the smallest cross-sectional area in the fluid flow path 104 (i.e., the one end 104*b*1 of the second flow path 104*b*).

The fluid flow path 104 is surrounded by a wall surface of a groove 152 formed on the lower substrate 160 and the back surface of the upper substrate 150. For this reason, the second flow path 104*b* and the third flow path 104*c* are also surrounded by a wall surface of the groove 152 formed on the lower substrate 160 and the back surface of the upper substrate 150. An antibody is immobilized on the wall surface of the groove 152 or the back surface of the upper substrate 150 in such a manner that the antibody is located on the peripheral surface of the second flow path 104*b* or the third flow path 104*c*. The region in which the antibody is immobilized is referred to as an antibody region 105. In FIG. 1B, the antibody region 105 is located in both of the second flow path 104*b* and the third flow path 104*c*. Alternatively, the antibody region 105 may be formed on either the second flow path 104*b* or the third flow path 104*c*.

The cross-sectional area of the second flow path 104*b* increases monotonically along the direction from the second flow path 104*b* toward the third flow path 104*c*. In other words, the cross-sectional area of the second flow path 104*b* increases monotonically along a direction X depicted in FIG. 1B (i.e., the direction indicated by an arrow X) from the one end 104*b*1 to the other end 104*b*2 of the second flow path 104*b*. As one example, the width W2 of the second flow path 104*b* increases monotonically along the direction X. Alternatively, the height H2 (See FIG. 1A) of the second flow path 104*b* may increase monotonically along the direction X. Both of the width W2 and the height H2 of the second flow path 104*b* may increase monotonically along the direction X. The second flow path 104*b* does not comprise a part in which its cross-sectional area is constant along the direction X. Similarly, the second flow path 104*b* does not comprise a part in which its cross-sectional area is decreased along the direction X.

On the other hand, the cross-sectional area of the third flow path 104*c* is constant or increased monotonically along the direction X. It is desirable that the cross-sectional area of the third flow path 104*c* is constant along the direction X. When the cross-sectional area of the third flow path 104*c* increase monotonically along the direction X, as one example, the width W3 of the third flow path 104*a* increases monotonically along the direction X. Alternatively, the height H3 (See FIG. 1A) of the third flow path 104*c* may increase monotonically along the direction X.

The cross-sectional area of the first flow path 104*a* is larger than the cross-sectional area at the one end 104*b*1 of the second flow path 104*b*. This is important. The reason will be described later.

As one example, the fluid flow path 104 suitable for μ-TAS may have lengths and widths as below.

Length L1 of the first flow path 104*a:* 10 micrometers-5000 micrometers Width W1 of the first flow path 104*a:* 10 micrometers-500 micrometers Length L2 of the second flow path 104*b:* 10 micrometers-500 micrometers Width W2 of the second flow path 104*b:* 10 micrometers-500 micrometers Length L3 of the third flow path 104*c:* 10 micrometers-5000 micrometers Width W3 of the third flow path 104*c:* 10 micrometers-500 micrometers It is desirable that the fluid flow path 104 does not have a part in which its cross-sectional area is decreased along the direction X between the third flow path 104*c* and the outlet 106. As one example, as shown in FIG. 1B, the third flow path 104*c* communicates directly with the outlet 106.

(Method for Fabricating the Micro Analysis Chip)

Hereinafter, a method for fabricating the above-mentioned micro analysis chip will be described with reference to FIG. 3A-FIG. 8.

Figure 3A:
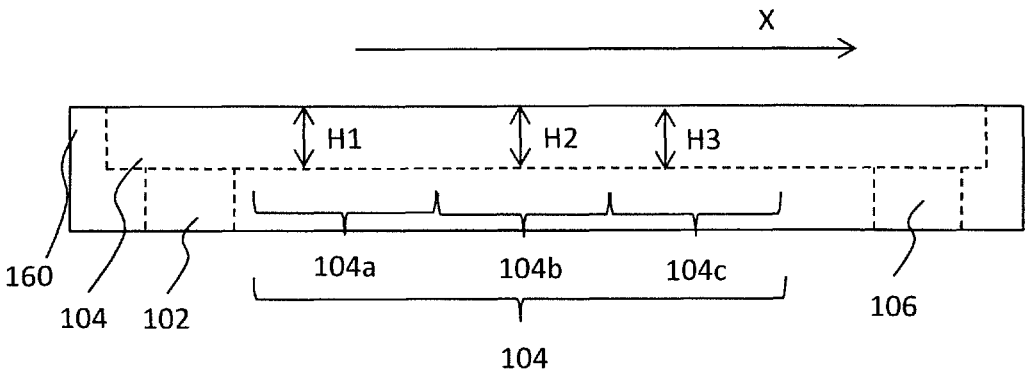
FIG. 3A shows a cross-sectional view in one step included in a method for fabricating the micro analysis chip according to the embodiment.
Figure 3B:
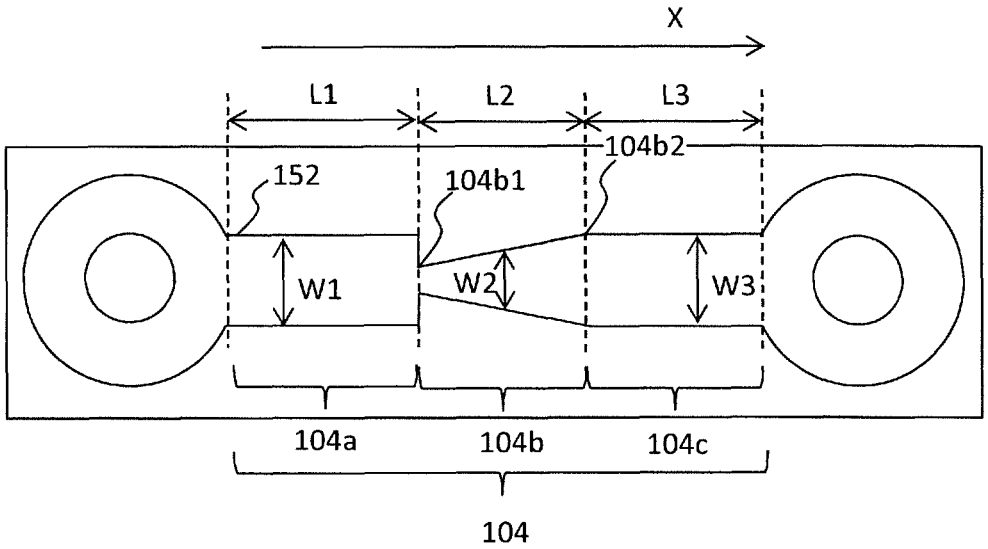
FIG. 3B shows a top view in one step included in a method for fabricating the micro analysis chip according to the embodiment.

First, a groove is formed on a surface of a substrate having a certain thickness to form the fluid flow path 104 on the surface thereof. The groove is formed by a photolithography method or an etching method. In this way, the lower substrate 160 as shown in FIG. 3A and FIG. 3B is prepared. In FIG. 3A and FIG. 3B, the inlet 102 and the outlet 106 are formed in the lower substrate 160. However, as shown in FIG. 1A and FIG. 1B, the inlet 102 and the outlet 106 may be formed in the upper substrate 150.

(Step (a))

Figure 4:
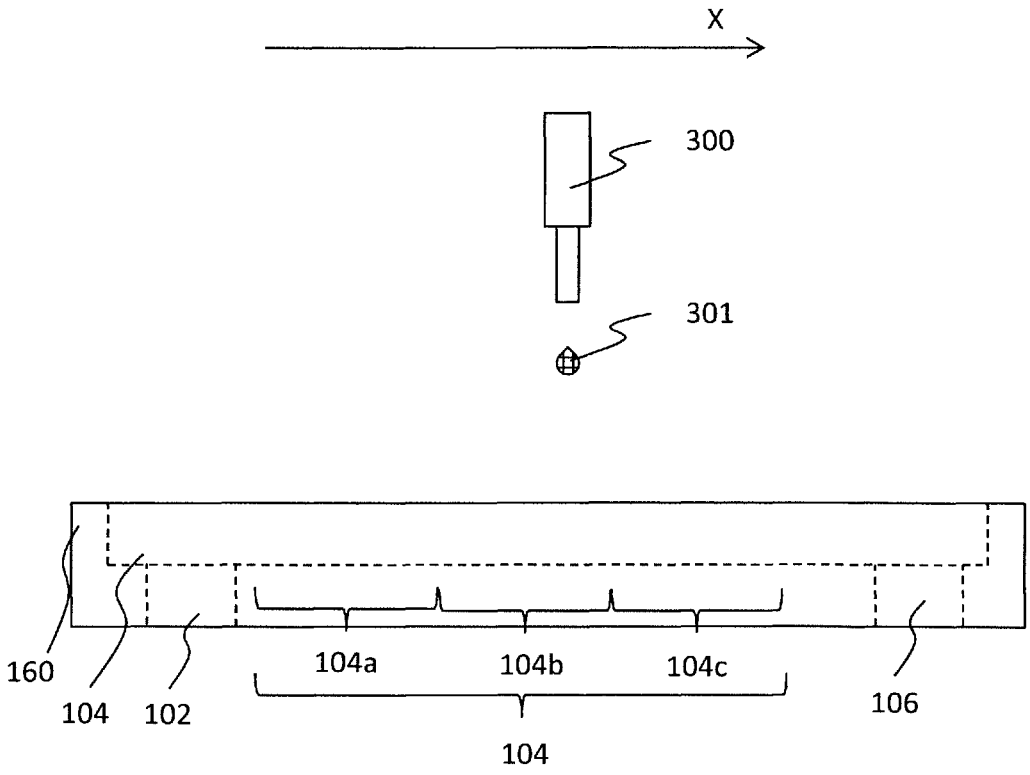
FIG. 4 shows a cross-sectional view in one step included in a method for fabricating the micro analysis chip according to the embodiment.
Figure 5A:
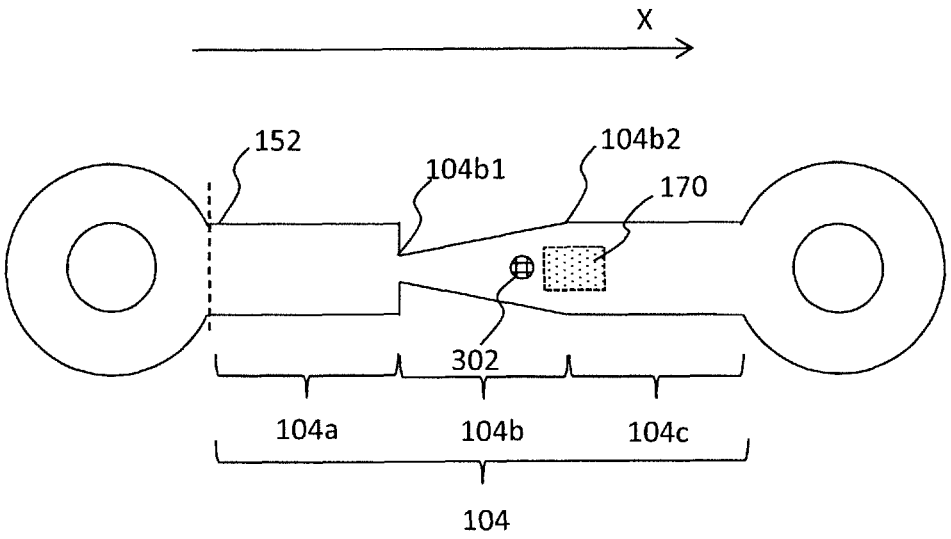
FIG. 5A shows a top view in one step, subsequent to FIG. 4, included in a method for fabricating the micro analysis chip according to the embodiment.

Next, as shown in FIG. 4, an aqueous solution containing an antibody is dropped as a droplet 301 toward the lower substrate 160. The droplet 301 is supplied to the second flow path 104*b*. It is desirable that the droplet 301 is dropped onto the second flow path 104*b*. The droplet 301 may be dropped onto the third flow path 104*c*. In this way, as shown in FIG. 5A, the aqueous solution 302 containing the antibody is supplied to the second flow path 104*b*. The droplet 301 may have a volume of 10 picoliters-10 nanoliters.

(Step (b))

Figure 5B:
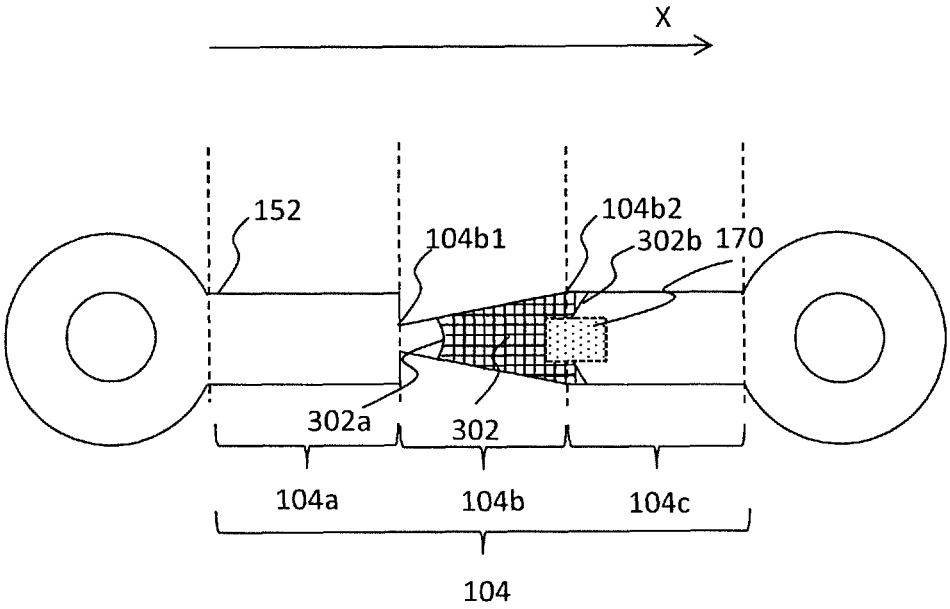
FIG. 5B shows a top view in one step, subsequent to FIG. 5A, included in a method for fabricating the micro analysis chip according to the embodiment.
Figure 5C:
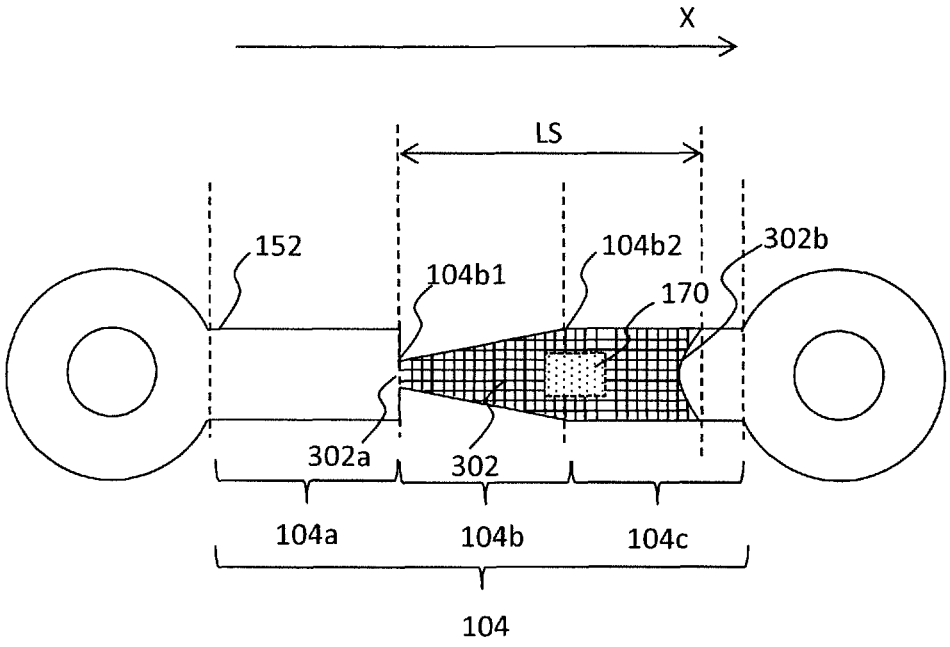
FIG. 5C shows a top view in one step, subsequent to FIG. 5B, included in a method for fabricating the micro analysis chip according to the embodiment.

The droplets 301 may be dropped towards to the lower substrate 160 more than once. As shown in FIG. 5B, the aqueous solution 302 is spread onto the peripheral surface of the second flow path 104*b*. Finally, as shown in FIG. 5C, the aqueous solution 302 is also spread onto the peripheral surface of the third flow path 104*c*. One droplet 301 may be dropped toward the lower substrate 160 to spread the aqueous solution 302 onto the fluid flow path 104, as shown in FIG. 5C.

In the step (b), the following relation (IAA) is satisfied:

$$LS \leq L2+L3 \quad \text{(IAA)}$$

where

LS represents the length of the liquid sample from the one end of the second flow path along the longitudinal direction of the fluid flow path;

L2 represents the length of the second flow path along the longitudinal direction in the fluid flow path; and L3 represents the length of the third flow path along the longitudinal direction in the fluid flow path.

The aqueous solution has one end 302*a* and the other end 302*b*.

It is desirable that the following relation (II) is satisfied:

$$LS < L2+L3 \quad \text{(II).}$$

The aqueous solution 302 hardly is spread to the first flow path 104*a*, since the cross-sectional area of the first flow path 104*a* is larger than the cross-sectional area at the one end 104*b*1 of the second flow path 104*b*. Since the cross-sectional area of the second flow path 104*b* is increased monotonically along the direction X, the aqueous solution 302 contained in the second flow path 104*b* is pulled toward a direction opposite to the direction X due to capillary force. Hereinafter, the direction opposite to the direction X is referred to as "−X direction")

Since the cross-sectional area of the first flow path 104*a* is larger than the cross-sectional area at the one end 104*b*1 of the second flow path 104*b*, the capillary force generated in the first flow path 104*a* is smaller than the capillary force generated in the second flow path 104*b*. For this reason, the aqueous solution which has reached the one end b1 of the second flow path 104*b* is not spread onto the first flow path 104*a*.

In case where the cross-sectional area of the first flow path 104*a* is equal to or smaller than the cross-sectional area of the one end 104*b*1 of the second flow path 104*b*, the capillary force generated in the first flow path 104*a* is equal to or larger than the capillary force generated in the second flow path 104*b*, the aqueous solution which has reached the one end b1 of the second flow path 104*b* is spread onto the first flow path 104*a*. The present invention does not include such a case.

The aqueous solution 302 is supplied to the fluid flow path 104 in this way is brought into contact with the second flow path 104*b* and the third flow path 104*c*.

Figure 8:
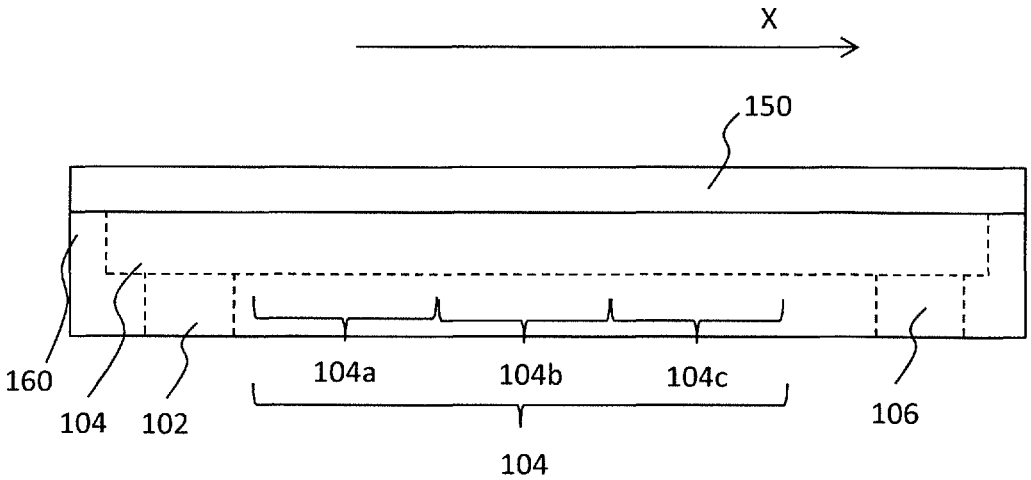
FIG. 8 shows a cross-sectional view in one step, subsequent to FIG. 7, included in a method for fabricating the micro analysis chip according to the embodiment.

Next, as shown in FIG. 8, the aqueous solution 302 is dried. The aqueous solution 302 may be dried naturally. Alternatively, the aqueous solution 302 is warmed to promote the drying.

(Step (c))

Figure 6:
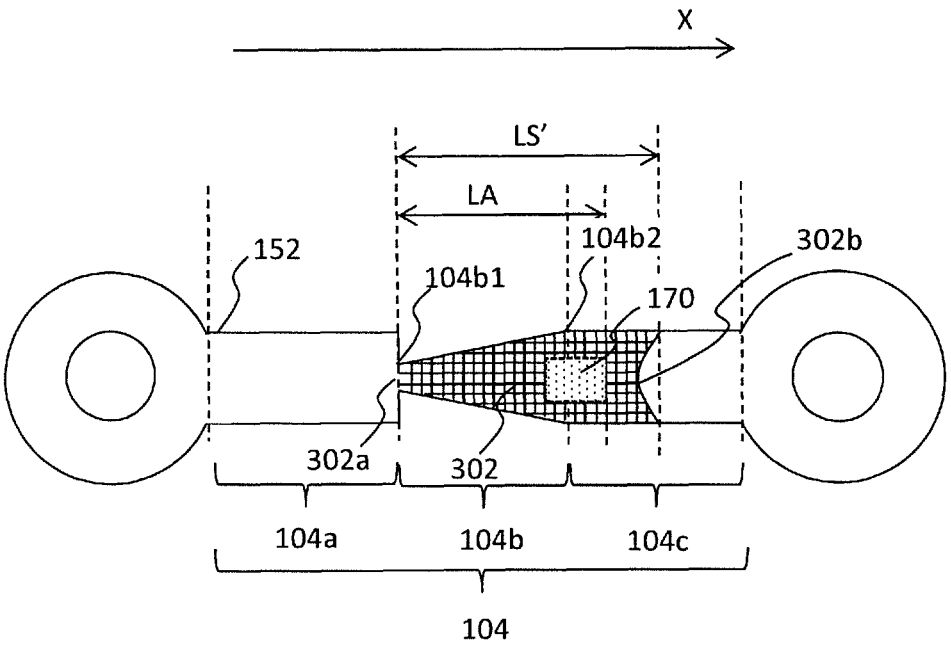
FIG. 6 shows a top view in one step, subsequent to FIG. 5C, included in a method for fabricating the micro analysis chip according to the embodiment.

Next, as shown in FIG. 6, the aqueous solution 302 is left at rest. The aqueous solution 302 is dried naturally. Alternatively, the lower substrate 160 was stored under a humidified atmosphere to prevent the drying of the aqueous solution 302 at minimum.

As a result, as shown in FIG. 6, the volume of the aqueous solution 302 is decreased. In other words, the following relation (IBB) is satisfied.

$$LA < LS' < LS \quad \text{(IBB)}$$

where

LA represents a distance between an analysis region 170 and the one end 104*b*1 of the second region 104*b*; and LS' represents the length from the one end 104*b*1 of the second flow path 104*b* to the other end 302*b* of the aqueous solution 302 along the direction X after the aqueous solution 302 is left at rest (See FIG. 6).

Figure 9A:
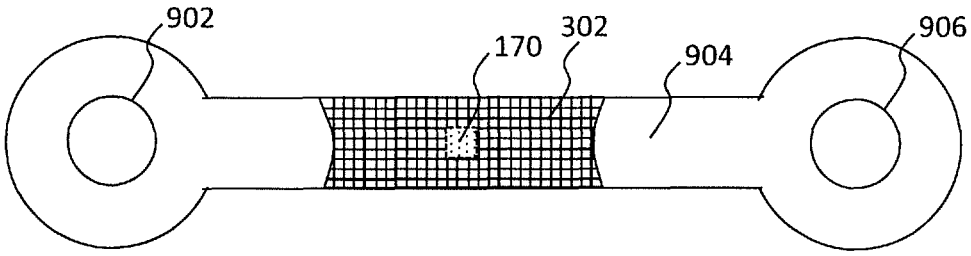
FIG. 9A shows a top view in one step included in a method for fabricating a conventional micro analysis chip.
Figure 9B:
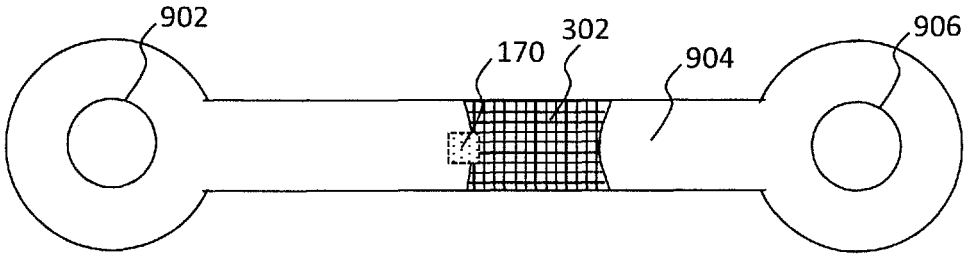
FIG. 9B shows a top view in one step included in a method for fabricating a conventional micro analysis chip.
Figure 9C:
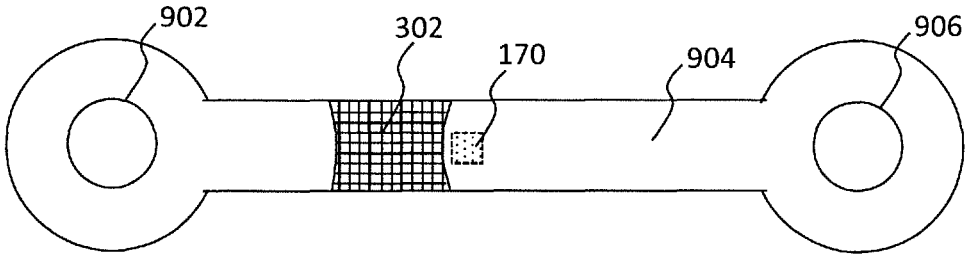
FIG. 9C shows a top view in one step included in a method for fabricating a conventional micro analysis chip.
Figure 10:
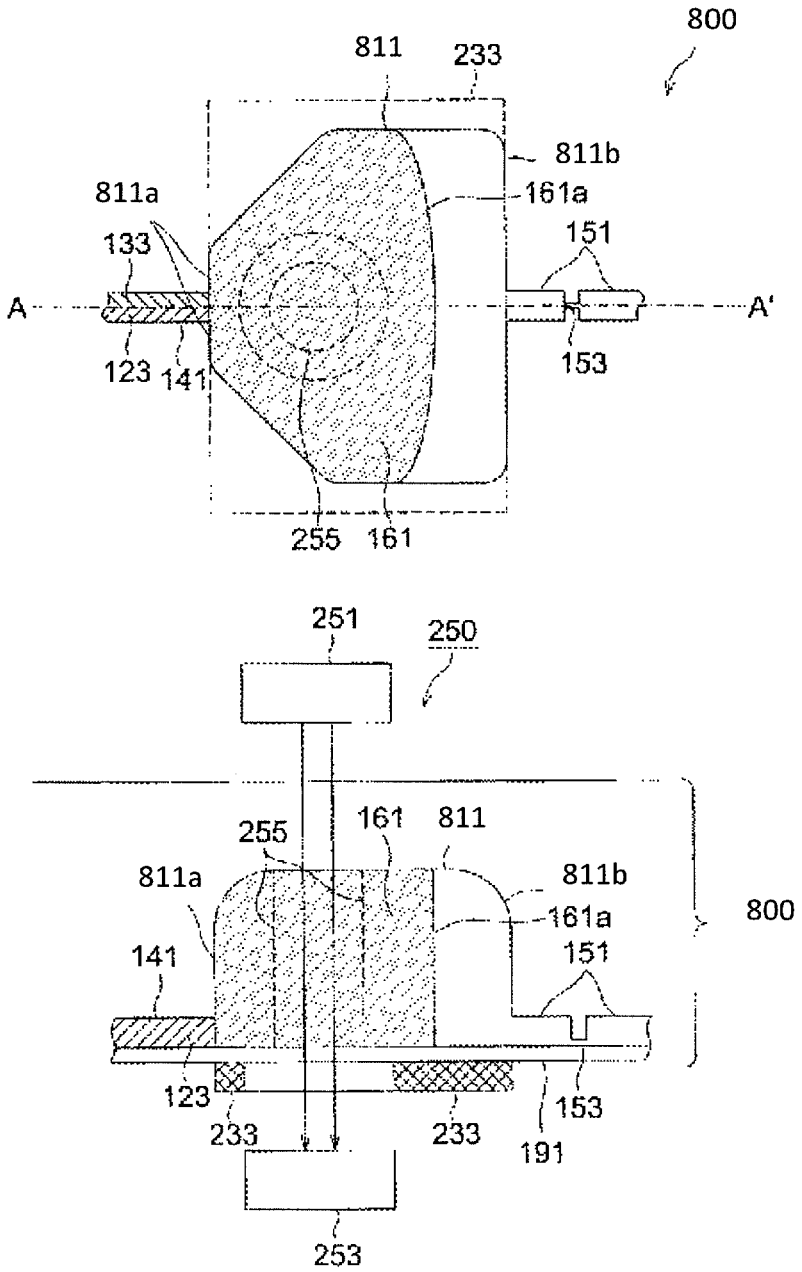
FIG. 10 is a duplicate of FIG. 5 included in Japanese Patent Application Unexamined Publication No. 2009-047485A.

Hereinafter, a problem in a case where the cross-sectional are of the flow path is consist will be described with reference to FIG. 9A, FIG. 9B, and FIG. 9C. As shown in FIG. 9A, the aqueous solution 302 containing the antibody is supplied to a flow path 904. Next, the aqueous solution 302 is dried to form an antibody region covering the analysis region 170. However, since the cross-sectional area of the flow path is constant, the aqueous solution 302 moves either rightward or leftward, while the aqueous solution 302 is dried. For this reason, as shown in FIG. 9B and FIG. 9C, the aqueous solution 302 may fail to cover the analysis region 170. As a result, the antibody region may fail to be formed on the analysis region 170.

On the other hand, in the present embodiment, the aqueous solution 302 is pulled along the −X direction due to capillary force as shown in FIG. 6, since the cross-sectional area of the second flow path 104*b* is monotonically increased along the direction X. In other words, since the cross-sectional area of the second flow path 104*b* is monotonically decreased along the −X direction, the aqueous solution 302 is pulled along the −X direction. In this way, one end 302*a* of the aqueous solution 302 is always positioned at the one end 104*b*1 of the second flow path 104*b*.

While the aqueous solution 302 is dried, the other end 302*b* of the aqueous solution 302 moves along the −X direction. However, the aqueous solution 302 is surely present at the one end 104*b*1 of the second flow path 104*b*. This is because the capillary force is generated along the −X direction in the second flow path 104*b*.

As previously described, since the cross-sectional area of the first flow path 104*a* is larger than the cross-sectional area of the one end 104*b*1 of the second flow path 104*b*, the aqueous solution 302 which has reached the one end 104*b*1 of the second flow path 104*b* is not spread onto the first flow path 104*b*.

For this reason, in the present invention, it is necessary that the cross-sectional area of the first flow path 104*a* is larger than the cross-sectional area of the one end 104*b*1 of the second flow path 104*b*.

Figure 7:
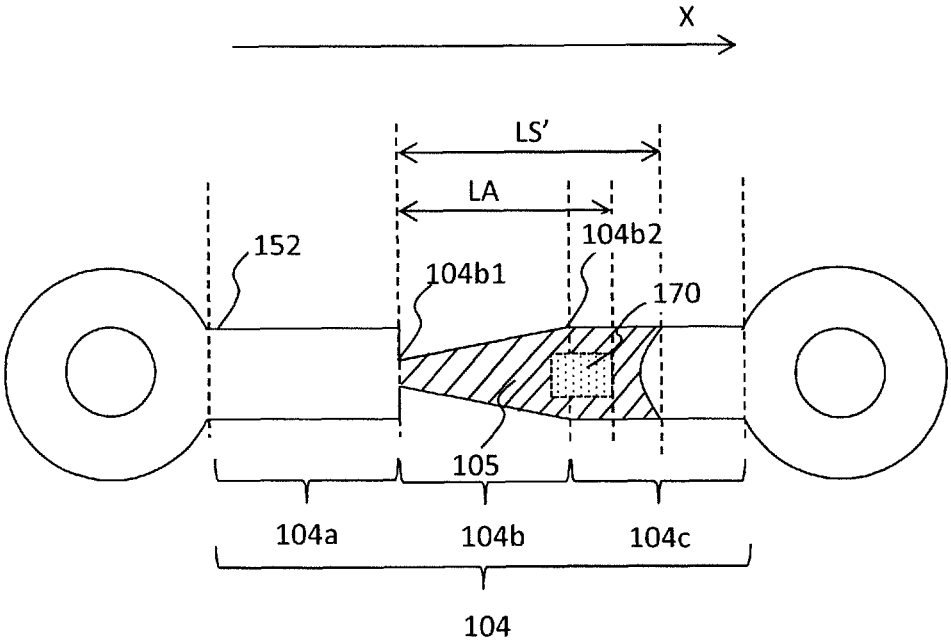
FIG. 7 shows a top view in one step, subsequent to FIG. 6, included in a method for fabricating the micro analysis chip according to the embodiment.

In this way, as shown in FIG. 7, the antibody region 105 is surely formed on the peripheral surface of the second flow path 104*b*. Before the aqueous solution 302 is dropped toward to the lower substrate 160, the lower substrate 160 may be subjected to a surface treatment. The surface treatment allows the antibody to be easily immobilized on the lower substrate. Such a surface treatment is well-known.

(Step (d))

Finally, as shown in FIG. 8, the upper substrate 150 is arranged as a lid onto the lower substrate 160. In this way, the micro analysis chip according to the present embodiment is fabricated.

(Method for Analyzing with the Micro Analysis Chip)

Next, a method for analyzing a liquid sample containing an antigen using the above-mentioned micro analysis chip will be described.

Figure 2:
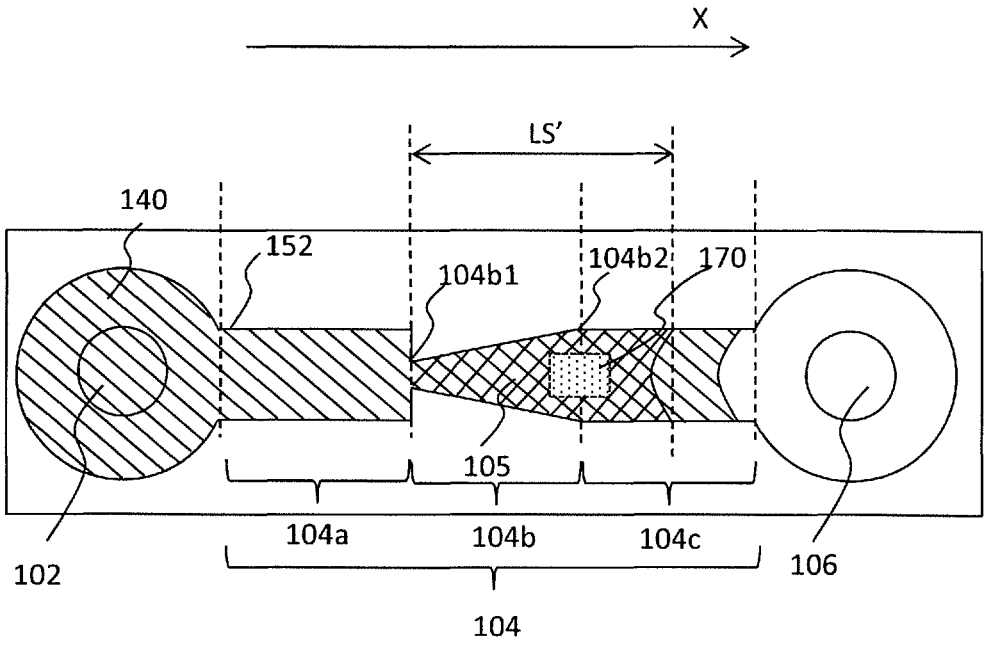
FIG. 2 shows a top view of the micro analysis chip in which a liquid sample has been supplied to the fluid flow path in a step (b)

As shown in FIG. 2, the liquid sample 140 is supplied from the inlet 102 to the fluid flow path 104.

For one example, the liquid sample 140 provided for a μ-TAS is supplied from the inlet 102 at a flow rate of 0.01 microliter/minute to 2 microliters/minute.

As a result, the liquid sample 140 is brought into contact with the antibody immobilized on the analysis region 170 included in the antibody region 105. Since the analysis region 170 is arranged at at least one of the second flow path 104*b* and the third flow path 104*c*, at least a part of the liquid sample 140 is required to be supplied to the second flow path 104*b*.

The antigen contained in the liquid sample 140 is bound to the antibody immobilized on the analysis region 170.

Then, the antigen bound to the antibody immobilized on the analysis region 170 included in at least one of the second flow path 104*b* and the third flow path 104*c* is analyzed. The analysis method is not limited. As one example, the antigen included in the liquid sample 140 is analyzed optically or electrochemically. Before the analysis of the antigen, a contamination present on the analysis region 170 may be removed by, for example, washing.

The present invention can be used to analyze the liquid sample obtained from a research participant near the research participant.

The inventions led from the above description will be listed below.

1. A method for fabricating a micro analysis chip, the method comprising:

(a) supplying an aqueous solution containing an antibody to a first substrate comprising a fluid flow path; wherein the fluid flow path comprises a first flow path, a second flow path, and a third flow path which are arranged continuously along a longitudinal direction of the fluid flow path;

the second flow path has one end and another end;

the first flow path communicates with the second flow path through the one end of the second flow path;

the second flow path is interposed between the first flow path and the third flow path;

the second flow path communicates with the third flow path through the other end of the second flow path;

a cross-sectional area of the third flow path is constant or increased monotonically along a direction X from the second flow path toward the third flow path;

a cross-sectional area of the second flow path is increased monotonically along the direction X from the one end to the other end of the second flow path;

a cross-sectional area of the first flow path is larger than a cross-sectional area at the one end of the second flow path; and the aqueous solution is supplied to the second flow path;

(b) bringing the aqueous solution into contact with an analysis region included in at least one of the second flow path and the third flow path;

wherein the following relation (IAA) is satisfied:

$$LS \leq L2 + L3 \quad \text{(IAA)}$$

where

LS represents the length of the liquid sample from the one end of the second flow path along the longitudinal direction of the fluid flow path;

L2 represents the length of the second flow path along the longitudinal direction in the fluid flow path; and L3 represents the length of the third flow path along the longitudinal direction in the fluid flow path; and (c) leaving the aqueous solution at rest;

wherein one end of the aqueous solution is located at the one end of the second flow path;

the other end of the aqueous solution moves along a direction opposite to the direction X;

the antibody is immobilized on the analysis region; and the following relation (IBB) is satisfied:

$$LA<LS'<LS \quad \text{(IBB)}$$

where

LA represents a distance between the analysis region and the one end of the second region; and LS' represents the length of the liquid sample in the step (c).

2. The method according to Item 1, wherein the following relation (II) is satisfied.

$$LS<L2+L3$$

3. The method according to Item 1, wherein the aqueous solution is also supplied to the third flow path in the step (a).

4. The method according to Item 1, further comprising:

(d) arranging a second substrate as a lid onto the lower substrate, after the step (c).

5. A micro analysis chip comprising:

an inlet; and a fluid flow path which communicates with the inlet; wherein the fluid flow path comprises a first flow path, a second flow path, and a third flow path which are arranged continuously along a longitudinal direction of the fluid flow path;

the second flow path has one end and another end;

the first flow path is interposed between the inlet and the second flow path;

the first flow path communicates with the second flow path through the one end of the second flow path;

the second flow path is interposed between the first flow path and the third flow path;

the second flow path communicates with the third flow path through the other end of the second flow path;

an antibody is bound on at least one peripheral surface selected from the group consisting of a peripheral surface of the second flow path and a peripheral surface of the third flow path;

a cross-sectional area of the third flow path is constant or increased monotonically along a direction X from the second flow path toward the third flow path;

a cross-sectional area of the second flow path is increased monotonically along the direction X from the one end to the other end of the second flow path; and a cross-sectional area of the first flow path is larger than a cross-sectional area at the one end of the second flow path.

6. The micro analysis chip according to Item 5, wherein the micro analysis chip further comprises an outlet;

the fluid flow path is interposed between the inlet and the outlet; and the fluid flow path does not comprises, between the third flow path and the outlet, a part in which its cross-sectional area is decreased along a direction from the second flow path to the third flow path.

7. A method for analyzing a liquid sample containing an antigen, the method comprising:

(a) preparing a micro analysis chip; wherein the micro analysis chip comprises:

an inlet; and a fluid flow path which communicates with the inlet;

the fluid flow path comprises a first flow path, a second flow path, and a third flow path which are arranged continuously along a longitudinal direction of the fluid flow path;

the second flow path has one end and another end;

the first flow path is interposed between the inlet and the second flow path;

the first flow path communicates with the second flow path through the one end of the second flow path;

the second flow path is interposed between the first flow path and the third flow path;

the second flow path communicates with the third flow path through the other end of the second flow path;

an antibody is immobilized on at least one peripheral surface selected from the group consisting of a peripheral surface of the second flow path and a peripheral surface of the third flow path;

a cross-sectional area of the third flow path is constant or increased monotonically along a direction X from the second flow path toward the third flow path;

a cross-sectional area of the second flow path is increased monotonically along the direction X from the one end to the other end of the second flow path;

a cross-sectional area of the first flow path is larger than a cross-sectional area at the one end of the second flow path; and a cross-sectional area of the first flow path is larger than a cross-sectional area of the one end of the second flow path;

(b) supplying the liquid sample from the inlet to the fluid flow path to bring the liquid sample into contact with the antibody and to bind the antigen contained in the liquid sample to the antibody, while the liquid sample is hold in the second flow path, and (c) analyzing the antigen bound to the antibody immobilized on the analysis region included in the second flow path and the third flow path.

8. The method according to Item 7, wherein the micro analysis chip further comprises an outlet;

the fluid flow path is interposed between the inlet and the outlet; and the fluid flow path does not comprises, between the third flow path and the outlet, a part in which its cross-sectional area is decreased along a direction from the second flow path to the third flow path.

REFERENCE SIGNS LIST

100 Micro analysis chip
150 Upper substrate
160 Lower substrate
102 Inlet
104 Fluid flow path
**104*a*** First flow path
**104*b*** Second flow path
**104*b*1** One end
**104*b*2** The other end
**104*c*** Third flow path
105 Antibody region
106 Outlet
140 Liquid sample
**140*a*** One end
**140*b*** The other end
152 Groove
170 Analysis region
300 Ink Jet Head
301 Droplet
302 Aqueous solution containing Antigen

302*a* One end of Aqueous solution 302
302*b* The other end of Aqueous solution 302
H1 Height of the first flow path 104*a*
H2 Height of the second flow path 104*b*
H3 Height of the third flow path 104*c*
L1 Length of the first flow path 104*a*
L2 Length of the second flow path 104*b*
L3 Length of the third flow path 104*c*
LA Length between the analysis region 170 and the one end 104*b*1 of the second flow path 104*b*
LS Length of the liquid sample 302 from the one end 104*b*1 of the second flow path 104*b*
LS' Length of the liquid sample 302 from the one end 104*b*1 of the second flow path 104*b*
W1 Width of the first flow path 104*a*
W2 Width of the second flow path 104*b*
W3 Width of the third flow path 104*c*

What is claimed is:

1. A method for fabricating a micro analysis chip, the method comprising:

(a) providing a substrate comprising a fluid flow path;

wherein:

the fluid flow path comprises a first flow path, a second flow path, and a third flow path which are arranged continuously along a longitudinal direction of the fluid flow path;

the second flow path has one end and another end;

the first flow path communicates with the second flow path through the one end of the second flow path;

the second flow path is interposed between the first flow path and the third flow path;

the second flow path communicates with the third flow path through the other end of the second flow path;

a width of the third flow path is constant or increases monotonically along a direction X from the first flow path toward the second flow path in a top view of the substrate;

a width of the second flow path increases monotonically along the direction X from the one end of the second flow path to the other end of the second flow path in the top view of the substrate; and a width of the first flow path is larger than the width of the second flow path at the one end of the second flow path in the top view of the substrate;

(b) dropping an aqueous solution containing an antibody onto a peripheral surface of the second flow path;

wherein:

a relation LS≤L2+L3 is satisfied, where:

LS represents a length of the aqueous solution from the one end of the second flow path along the longitudinal direction of the fluid flow path;

L2 represents a length of the second flow path along the longitudinal direction of the fluid flow path; and L3 represents a length of the third flow path along the longitudinal direction of the fluid flow path; and (c) drying the aqueous solution to bind the antibody to the peripheral surface of the second flow path;

wherein:

one end of the aqueous solution is located at the one end of the second flow path;

another end of the aqueous solution moves along a direction opposite to the direction X;

the antibody is immobilized at least partially on an analysis region on the fluid flow path; and a relation LA<LS'<LS is satisfied, where:

LA represents a distance between the one end of the second flow path and an end of the analysis region farthest from the one end of the second flow path; and LS' represents the length of the aqueous solution as a result of the step (c).

2. The method according to claim 1, wherein:

a relation LS<L2+L3 is satisfied.

3. The method according to claim 1, wherein:

the aqueous solution is also dropped onto a peripheral surface of the third flow path in the step (b).

4. The method according to claim 1, wherein the substrate is a first substrate and the method further comprises:

(d) arranging a second substrate as a lid onto the first substrate, after the step (c).

* * * * *